US005251530A

United States Patent [19]

Kaeser

[11] Patent Number: 5,251,530

[45] Date of Patent: Oct. 12, 1993

[54] METHOD FOR ASSEMBLING A HOLLOW-CHARGE PROJECTILE

[75] Inventor: Rudolf Kaeser, Thun, Switzerland

[73] Assignee: Schweizerische Eidenossenschaft Vertreten Durch Die Eidg. Munitionsfabrik Thun Der Gruppe Fur Rustungsdienste, Switzerland

[21] Appl. No.: 817,796

[22] Filed: Jan. 8, 1992

[30] Foreign Application Priority Data

Jan. 11, 1991 [CH] Switzerland ..... 00062/91

[51] Int. Cl.[5] ..... F42B 33/02

[52] U.S. Cl. ..... 86/20.14; 86/20; 102/476

[58] Field of Search ..... 86/1.1, 20.1, 20.12, 86/20.14; 102/306-310, 476; 264/3.1

[56] References Cited

U.S. PATENT DOCUMENTS

| | | | |
|---|---|---|---|
| 3,961,554 | 6/1976 | Harris et al. | 86/1 R |
| 4,250,792 | 2/1981 | Deigmuller et al. | 86/1.1 |
| 4,651,618 | 3/1987 | Ringel et al. | 86/20.14 |

FOREIGN PATENT DOCUMENTS

| | | | |
|---|---|---|---|
| 3236706 | 4/1984 | Fed. Rep. of Germany | 102/306 |
| 3434847 | 11/1985 | Fed. Rep. of Germany . | |
| 3843886 | 5/1990 | Fed. Rep. of Germany . | |
| 2563517 | 10/1985 | France . | |
| 676502 | 1/1992 | Switzerland | 102/306 |

*Primary Examiner*—Harold J. Tudor

*Attorney, Agent, or Firm*—Wegner, Cantor, Mueller & Player

[57] ABSTRACT

A hollow-charge projectile is provided with a precision charge (12) which, on the one hand, is surrounded on the outside by a metallic jacket (11) and, on the other hand, is lined on the inside with an insert (13). During assembly there exists the danger of formation, due to thermal expansion, of cracks, cavities or fissures between the three components (11, 12, 13). This is avoided by first cooling down the precision charge (12), heating the jacket (11) and introducing the precision charge (12) into the jacket (11), and by subsequently heating the jacketed precision charge (12), cooling the insert (13) and pressing the insert into the precision charge (12). The thus assembled components (11, 12, 13) are brought to room temperature.

11 Claims, 2 Drawing Sheets

METHOD FOR ASSEMBLING A HOLLOW-CHARGE PROJECTILE

FIELD OF THE INVENTION

The invention relates to a method for assembling a hollow-charge projectile comprising a precision charge, a metallic jacket and an insert, whereby at least the precision charge is cooled down and introduced into the metallic jacket under use of the thermal expansion of the above components, as well as the use of the method and a hollow-charge projectile produced according thereto.

The above-mentioned inserts, also known as casings or liners, serve for the formation of jets by hollow charges.

BACKGROUND OF THE INVENTION

A method is known for the assembling of a hollow charge (DE-C-3 434 847), in which the liner and the explosive charge are resiliently pressed one against the other, the explosive charge being cooled down to a temperature corresponding to the lowest operational temperature, the liner, the cooled-down explosive charge and additional components then being introduced into the jacket.

Although by this method it is possible to avoid gaps between the jacket and the explosive charge, no measures are foreseen to reliably avoid gaps also between the explosive charge and the liner, especially if the latter is not precisely conical.

It is further known to use pressure to press a body of an explosive mixture consisting of Hexogen and TNT into a pressing mold, to cool it down and then to heat the liner to 85° C. to 95° C. and to press it during the cooling-down process into the cavity of the body (DE-A-3 236 706). Air inclusions between the body and the insert are thus prevented, but because of the danger of detonation during the process, it is impossible to heat the entire liner. Air gaps between the liner and the body can thus hardly be avoided.

Another method for producing hollow-charge projectiles is known, in which the explosive charge is prepressed and cooled down to −30° C. (FR-A-2 563 517). At ambient temperature and under high pressure, the explosive charge is pressed into the projectile jacket together with its liner. Subsequently, a mounting ring is screwed into the former, which fixes the liner by application of force. After equalization of temperature, high mechanical stresses prevail inside the projectile, which act on the separate components.

With the known methods, the explosive charge is pressed onesidedly into the body by application of pressure during the assembling of the ammunition. While the risks during the manufacturing of the projectiles are considerably less than with the method according to FR-A-2 563 517, the projectile jacket must have a wall of sufficient mechanical strength to withstand the forces prevailing during pressing. According to experience, it is therefore only possible to use projectile jackets having relatively thick walls which tend towards fragmentation. Using the above methods, it is in no case possible to produce projectiles for missiles and rocket projectiles, since it is precisely the walls of these projectiles that, because of weight considerations, must be as thin as possible.

The commonly used materials for these three components—precision charge, metallic jacket and liner—have usually different values concerning modulus of elasticity, Poisson's ratio and coefficient of thermal expansion. For the metallic jacket one uses mostly a light-metal alloy or steel, for the liner, copper is suitable, and the explosive charge is prepared from the plastics or wax-bonded explosive known as HMX (octogen=cyclotetramethylenetetranitramine)) or RDX (hexogen=cyclotrimethylenetrinitramine).

SUMMARY OF THE INVENTION

It is an object of the invention to describe a method ensuring a crack and gap-free assembling of a precision charge with an outer thin-walled metallic jacket and an inner hollow-charge liner.

The precision charge can develop its full effect only when it is enveloped on all sides without gaps both by the jacket and by the liner, with this demand to be met within a temperature range of −35° C. to +63° C. As the temperature behavior of the above-mentioned materials differs, the danger exists of the creation of gaps and cracks, which must be prevented by all means.

This problem is solved in accordance with the method of the invention.

With this method it is advantageous for the coefficient of thermal expansion of the explosive to exceed the coefficients of thermal expansion of both the liner and the jacket over the entire, or at least the upper, region of the required temperature range.

With this method it is advantageous for the coefficient of thermal expansion of the explosive to equal the coefficients of thermal expansion of both the liner and the jacket over the entire, or at least the upper, region of the required temperature range.

The precision charge should be introduced into the jacket in an unstressed state, in order to improve the quality of the projectile.

It is furthermore desirable to adapt the shape of the liner to the method.

The method has the important advantage in that even with temperature fluctuations in the temperature range expected for operation, no tensile-stress-caused fissures occur in the precision charge, and therefore gaps and cavities between jacket, explosive charge and liner are avoided.

It is a further object of the invention to present a method that, with operational temperatures of the ammunition of between −35° C. and +63° C., ensures an airgap-less interface between explosive charge and projectile jacket, especially also when the projectile jacket is of so light a design that, for reasons of mechanical strength, it must not be pressed or re-pressed. At the same time, it is an object of the invention to describe a particularly lightweight ammunition body which can be produced by this novel method.

The press-formed precision charge, accurate with regard to shape and dimensions, is preferably cooled down to a temperature of between −50° C. and −100° C. and the metallic jacket is heated to a temperature of between +50° C. and +80° C. Subsequently, the jacketed precision charge is heated to an intermediate temperature of between −15° C. and −35° C., at which the coefficients of thermal expansion of the explosive and the metallic jacket are identical, and the liner is cooled down to a temperature of between −50° C. and −100° C.

The invention has the enormous advantage that it facilitates the production of lightweight projectiles without air inclusions in very large batches. Also the greater dangers during handling, such as premature detonations, need hardly be feared any longer.

It is of particular advantage in conjunction with the method according to the invention if the precision charge is press-formed isostatically according to CH PS 673 704, since this results in a very homogeneous, non-textured explosive-charge body accurate with respect to shape and dimensions.

In order to obtain a sufficiently homogeneous temperature distribution in the explosive charge, it should be cooled down together with its protective wrapper for two hours.

A further advantage of the protective wrapper enveloping the explosive charge is the fact that, during the cooling period, no frost is formed on the explosive charge. This also helps to avoid the problems which otherwise, during the assembling process, lead to undesirable water inclusions. The protective wrapper advantageously consists of a plastic foil which is not embrittled even at low temperatures.

By press-forming, especially by isostatic press-forming, the explosive charge is imparted a sufficiently high mechanical strength, so that the charge can be worked by machining.

It is particularly easy to produce ammunition bodies with jackets made of light metal or glass-fiber or carbon-fiber reinforced plastics.

Such projectiles have mostly very thin walls, practically of a thickness between 1.0 and 2.0 mm, no assembling problems being encountered thanks to the described method.

Proven explosives for the precision charge of a hollow-charge projectile are, in particular nitropenta (pentaerythritetetranitrate), hexogen (RDX) with or without trinitrotoluene, or octogen (HMX) with a phlegmatizing additive such as wax or methyl methacrylate.

The method can be used for the production of thin-walled ammunition bodies for anti-aircraft defense and for rocket missiles.

Further advantages become evident from the description below, in which the invention is explained in detail with the aid of several examples illustrated in the attached drawings.

DETAILED DESCRIPTION OF THE PREFERRED EMBODIMENTS

Figure 1A:
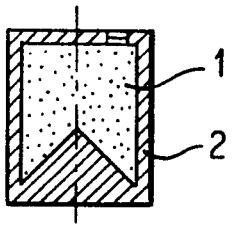
FIGS. 1*a–i* represent the separate, basic method steps for the production of an ammunition body.
Figure 1C:
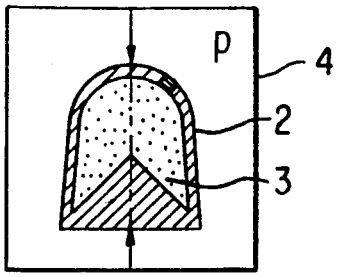
Figure 1B:
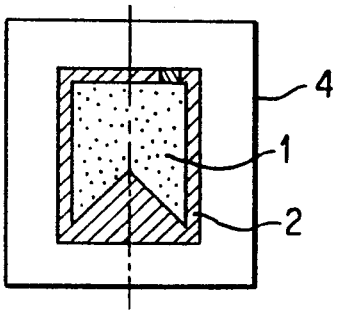
Figure 1D:
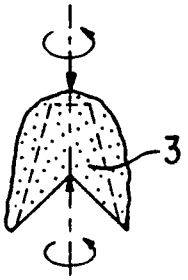

The pulverulent explosive 1 is filled into an elastic pressing mold 2, FIG. 1*a*. Then, the filled mold is put into an autoclave 4, FIG. 1*b*, and isostatically pressed at a pressure of e.g. 300 MPa, producing the precision charge 3, see FIG. 1*c*. A detailed description of the isostatic pressing method can be found in CH-PS 673 704. If need be, the press-formed explosive charge 3 can be machined, producing a final shape of very narrow tolerances, FIG. 1*d*.

Figure 1E:
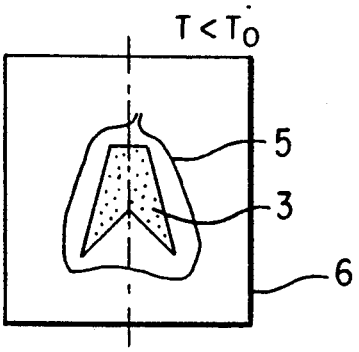

The precision charge 3 is placed into a cooling chest 6 and cooled down to −50° C. to −100° C., preferably −90° C, see FIG. 1*e*. To prevent embrittling of the explosive charge and/or the formation of fissures, the temperature should not be below −100° C. Any fissures in the explosive charge 3 reduce the final ballistic effect of the ammunition bodies produced, which must be usable in a temperature range of between −35° C. and +63° C. For cooling down, the explosive charge 3 is loosely enveloped in a protective wrapper 5 and the seam of the wrapper is sealed. Plastic foils that do not become brittle, especially at low temperatures, were found suitable as protective wrappers 5.

According to the invention, dwell time in the cooling chest 6 should be at least 2 hours and depends on the size of the charge. It is, however, also possible to use a continuous refrigeration plant as cooling chest 6, with the precision charge 3 being slowly moved on a conveyor through the tunnel of the plant, i.e., for at least two hours. At the same time, the metallic jacket 7 is heated in an oven 8 to a temperature of between +50° C. and +80° C., preferably +60° C., FIG. 1*f*.

Figure 1G:
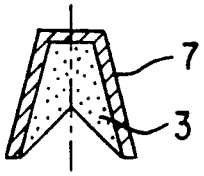
Figure 1F:
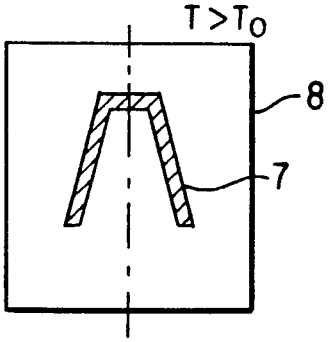

After that, the protective wrapper 5 is removed from the explosive charge 3, and the cold precision charge 3 and the warm projectile jacket 7 are freely assembled, without use of additional components or application of external force, see FIG. 1*g*. The object consisting of the explosive charge 3 and the jacket 7 is now brought to an intermediate temperature, which produces an airgapless force fit between the explosive charge 3 and the metallic projectile jacket 7, which fit is maintained without problems throughout the prescribed working temperature range of −35° C. to +63° C. This intermediate temperature depends on the explosive and the jacket material, and varies mostly between −35° C. and −15° C. When using octogen phlegmatized with methyl methacrylate as explosive and the alloy Perunal as jacket material, this intermediate temperature is −31° C.

Figure 1H:
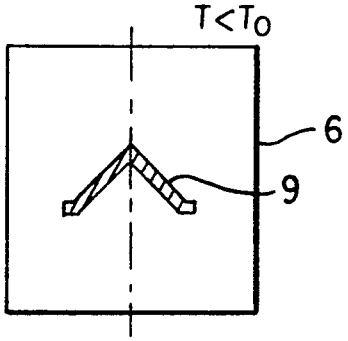
Figure 1I:
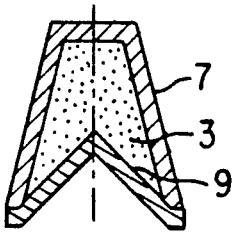

After this, the liner 9, cooled down to −50° C. to −100° C., preferably −80° C., is introduced into the explosive charge 3, FIGS. 1*h* and 1*i*. This last operation is carried out under slight pressure, so that an airgapless fit is produced between the object: explosive charge and jacket, and the liner, which fit is maintained also at higher temperatures.

The above-described method for producing ammunition bodies is particularly suitable for the manufacturing of projectiles for anti-aircraft defense and of rocket missiles, since these use such highly explosive precision charges as nitropenta, hexogen with or without trinitrotoluene, or octogen.

Principally used for such projectiles are light-metal sheets such as aluminum sheets, but also glass fiber or carbon fiber reinforced plastics The walls of these metallic jackets have a thickness of between 1.0 and 2.0 mm, preferably 1.5 mm.

The two practically realized embodiments, FIGS. 2 and 3, differ from each other by additional elements found in FIG. 3, a booster charge and a barrier, as will be explained further below in detail.

Figure 2:
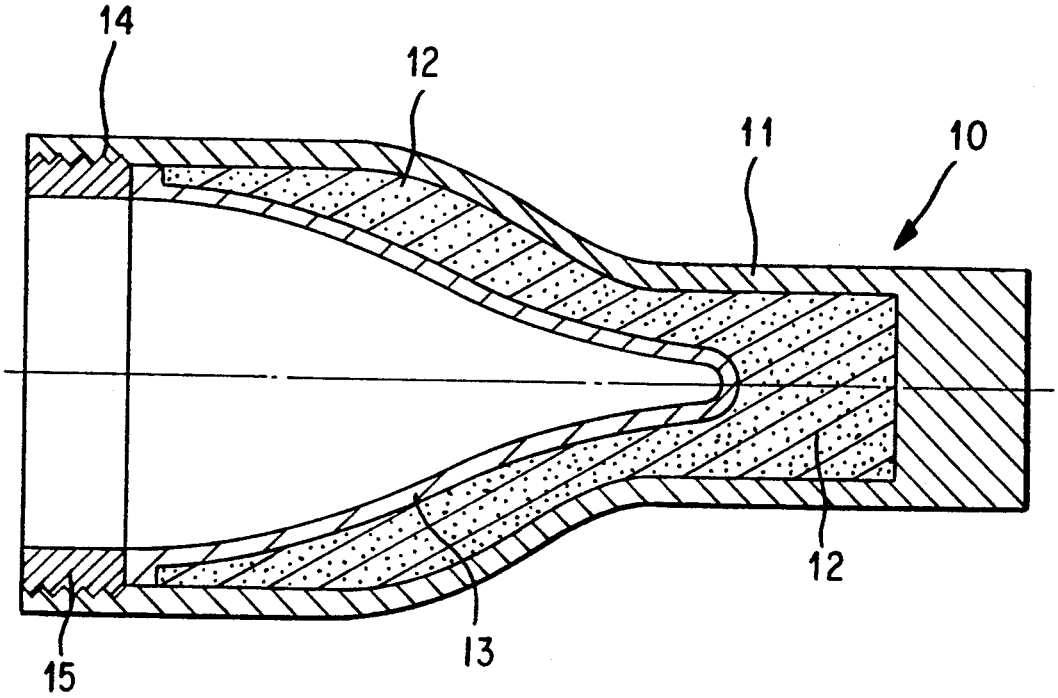
FIG. 2 is a longitudinal cross-section of a first embodiment of the hollow-charge projectile as produced according to the invention (one-piece explosive body)

As seen in FIG. 2, the hollow-charge projectile 10 according to the invention comprises a casing or a metallic jacket 11 in which is accommodated an explosive body or a precision charge 12. At its inside, this precision charge 12 is provided with an insert 13. The casing or metallic jacket 11 has at one of its ends an internal thread 14 into which is screwed a threaded ring 15.

Figure 3:
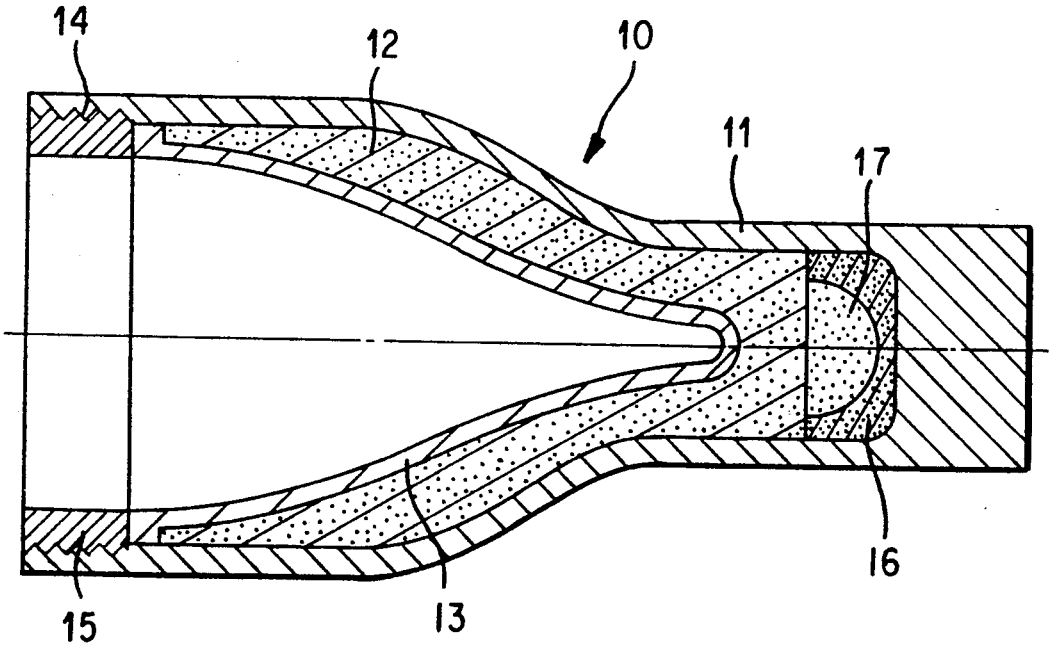
FIG. 3 is a longitudinal cross-section of a second embodiment (compound explosive body).

According to FIG. 3, the hollow-charge projectile 10 produced according to the invention comprises, in addition to the above-mentioned elements, in particular the jacket 11, the precision charge 12, the insert 13 and the threaded ring 15, also a booster charge 16 and a barrier layer 17. The precision charge 12, the barrier 17 and the booster charge 16 form preferably a single body which is introduced into the jacket 11 as an integral unit.

The method according to the invention thus consists of the following:

a. cooling down the precision charge 12
b. heating the jacket 11
c. introducing the cooled-down precision charge 12 into the heated jacket 11
d. heating the precision charge 12 encased in the jacket 11 to down the insert 13
f. fitting the cooled-down insert 13 into the precision charge
g. applying pressure to the unit thus produced by means of a threaded ring 15
h. bringing the thus assembled components to an optional ambient temperature within the operational range.

The above-mentioned components, especially the precision charge 12, the metallic jacket 11 and the insert or liner 13, are assembled in such a way that no fissures are produced in the precision charge 12, and that no gaps and cracks are produced, on the one hand, between the precision charge 12 and the metallic jacket 11, and, on the other, between the precision charge 12 and the insert 13.

CALCULATION EXAMPLE

1. Basic Assumptions

The assembled metallic components of the hollow charge have dimensions and tolerances that are valid for a temperature of 20° C. (room temperature).

The bonds between the explosive body and the metallic components permit only transmission of compressive stresses, not of tensile and/or shear stresses.

Concerning the interface between the insert 13 and the threaded ring 15, the joint between these two is assumed to be fixed.

Concerning the interface between the insert 13 and the metallic jacket 11, freedom of movement in the axial direction and absence of tensile stresses in the radial direction are assumed.

2. Simulation of the Thermoelastic Processes

2.1 Determination of the Explosive Quantity Required

The model defined in the basic assumptions is cooled down to a temperature at which the coefficient of thermal expansion of the explosive and that of the metallic component are identical (at about −30° C.).

Gaps between the explosive body 3 and the metallic jacket 7 or the liner 9 produced by the above are filled with explosive in such a way that, at the intermediate temperature of about −30° C., pressure-free contact is achieved.

The model, corrected at about −30° C., is further cooled down to the minimum operational temperature (−35° C.). Any further gaps created during the aforegoing are again filled up with explosive.

The thus defined hollow charge is heated up to 20° C. (room temperature).

2.2 Determination of the Contours of the Explosive Charges to be Machined

The practical contours of the explosive charge are found from the above simulation by removing the metallic components of the hollow charge such as the jacket 7 and the liner 9.

At this point the manufacturing tolerances, at 20° C., of both the explosive charge and the metallic components should be taken into account, which leads to a slight oversize of the explosive body to be machined.

2.3 Determination of the Compressive Stresses in the Explosive Body and in the Metallic Jacket The distribution of stresses, especially the distribution of pressures on explosive and jacket, are determined at the maximal operational temperature (+63° C.), with dimensional deviations assumed to be zero and the stresses or pressures created being calculated according to VON MISES.

Here it should be noted that the pressed explosive charge is not plastically deformed, provided the stresses or pressures in the explosive do not exceed the press-forming pressure.

3. Numerical Example

The numerical calculation of a precision charge of a caliber of 120 mm was carried out with the finite-element program ABAQUS (a commercially available program distributed by Hibit, Karlsson & Sorenson, Inc., Providence, R.I., U.S.A.).

The following thermoelastic parameters were used:

For the explosive, octogen phlegmatized with methyl methacrylate:

Modulus of elasticity $E_s = 1{,}200$ N/mm$^2$, constant over the relevant temperature range;

POISSON's ratio = 0.1

Coefficient of thermal expansion $\alpha_s$, a function of temperature, represented by a polynomial of the third degree:

$$\alpha_s = (4.08 + 0.0625\Theta + 0.00028\Theta^2 - 0.00000104\Theta^3) \times 10^{-5}\ 1/°K.$$

For a light-metal jacket made of the ASTM 7075 alloy:

Modulus of elasticity $E_n = 70{,}000$ n/mm$^2$, constant over the relevant temperature range;

POISSON's ratio = 0.3

Coefficient of thermal expansion $\alpha_h = 2.36 \times 10^{-5}$ 1/°K., constant over the relevant temperature range.

For the liner made of pure electrolytic copper:

Modulus of elasticity $E_{Cu} = 125{,}000$ N/mm$^2$, constant over the relevant temperature range;

POISSON's ratio = 0.3

Coefficient of thermal expansion $\alpha_{Cu} = 1.9 \times 10^{-5}$ 1/°K., constant over the relevant temperature range.

The calculation showed a maximum dimensional deviation of 0.12 mm at the liner base. Here the thickness of the explosive charge is 2 mm radially measured, and that of the metallic jacket, 1 mm.

The highest three-dimensional compressive stress prevailing in the explosive charge occurs, however, at the liner point and amounts to $$2.43\ N/mm^2$$

as calculated according to VAN MISES. This value lies below the pressure at which the explosive charge was compacted (about 200 $N/mm^2$).

The maximum stress in the jacket occurs at the maximum temperature of +63° C., with a corresponding three-dimensional stress of $$110\ N/mm^2$$

and is still within the elastic range of the aluminum alloy.

These examples of calculations indicate that the problems posed above, namely, how to ensure:

a. a fissure and crack-free assembly of a precision charge with an outer, thin-walled jacket and an inner hollow-charge liner, and b. an airgap-less fit between explosive charge and projectile jacket at an operating temperature of the ammunition of between −35° C. and +63° C.

can be solved with absolute exactness. The calculation examples thus show that, at both very low and very high temperatures, no fissures or cracks will appear in the hollow-charge projectile produced according to the invention, the required quality of the projectile thus being guaranteed.

I claim:

1. A method for assembling a hollow-charge projectile including a precision charge, a metallic jacket and an insert, comprising the steps of:

at first, cooling down the press-formed precision charge, accurate with regard to shape and dimensions, to a first predetermined temperature;

heating the metallic jacket to a second predetermined temperature;

introducing the precision charge, in an unstressed state, into the metallic jacket;

subsequently heating the jacketed precision charge to an intermediate temperature between said first predetermined temperature and said second predetermined temperature;

cooling the insert to a third predetermined temperature; and axially pressing the insert into the jacketed precision charge so that it is fixedly held by force therein.

2. The method according to claim 1, wherein said first predetermined temperature is between −50° C. and −100° C., said second predetermined temperature is between +50° C. and +80° C., said intermediate temperature is between −35° C. and −15° C., and said third predetermined temperature is between −50° C. and −100° C.

3. The method according to claim 1, wherein the coefficient of thermal expansion of the explosive exceeds the coefficients of thermal expansion of the insert and the jacket over at least an upper region of an operational temperature range.

4. The method according to claim 1, wherein the coefficient of thermal expansion of the explosive equals the coefficients of thermal expansion of the insert and the jacket over at least an upper region of an operational temperature range.

5. A method for attaching a precision charge to a metallic jacket according to claim 1, wherein the precision charge is press-formed.

6. A method for attaching a precision charge to a metallic jacket according to claim 1, wherein the precision charge is cooled for at least 2 hours.

7. A method for attaching a precision charge to a metallic jacket according o claim 1, wherein the precision charge is enveloped in a protective wrapper while being cooled.

8. The method according to claim 1, wherein the shapes and dimensions of the precision charge is at least partly achieved by machining.

9. The method according to claim 1, wherein said projectile is a thin-walled ammunition body for anti-aircraft defense and rocket missiles.

10. A method according to claim 1, further comprising the steps of: subsequently bringing the thus assembled components to ambient temperature.

11. A method for attaching a precision charge to a metallic jacket according to claim 1, wherein the precision charge is isostatically press-formed.

* * * * *